US005648699A

United States Patent [19]

Jin et al.

[11] Patent Number: 5,648,699

[45] Date of Patent: Jul. 15, 1997

[54] FIELD EMISSION DEVICES EMPLOYING IMPROVED EMITTERS ON METAL FOIL AND METHODS FOR MAKING SUCH DEVICES

[75] Inventors: Sungho Jin, Millington; Gregory Peter Kochanski, Dunellen; Wei Zhu, North Plainfield, all of N.J.

[73] Assignee: Lucent Technologies Inc., Murray Hill, N.J.

[21] Appl. No.: 555,594

[22] Filed: Nov. 9, 1995

[51] Int. Cl.[6] ..... H01J 1/30; H01J 9/02

[52] U.S. Cl. ..... 313/309; 445/24; 445/50; 313/311

[58] Field of Search ..... 313/309, 336, 313/311; 445/24, 50

[56] References Cited

U.S. PATENT DOCUMENTS

| | | | |
|---|---|---|---|
| 4,940,916 | 7/1990 | Borel et al. | 313/306 |
| 5,129,850 | 7/1992 | Kane et al. | 445/24 |
| 5,138,237 | 8/1992 | Kane et al. | 315/349 |
| 5,283,500 | 2/1994 | Kochanski | 315/58 |
| 5,290,610 | 3/1994 | Kane et al. | 427/78 X |
| 5,439,753 | 8/1995 | Rogers | 427/78 X |

OTHER PUBLICATIONS

R. Iscoff, "Flat Panel Displays: What's All The Fuss About:", *Semiconductor International*, p. 46 (1991).

C. A. Spindt et al. "Field–Emiter Arrays for Vacuum Microelectronics," *IEEE Transactions on Electron Devices*, vol. 38, pp. 2355–2363 (1991).

I. Brodie and C.A. Spindt, *Advances in Electronics and Electron Physics* edited by P. W. Hawkes, vol. 83, pp. 75–87 (1992).

J. A. Costellano, *Handbook of Display Technology* Academic Press, NY, pp. 254–257 (1992).

Okano et al., "Fabrication of a diamond field emitter array", *Appl. Phys. Lett.* vol. 64, p. 2742–2744 (May 1994).

*Primary Examiner*—Kenneth J. Ramsey

*Attorney, Agent, or Firm*—Eugen E. Pacher

[57] ABSTRACT

The present invention provides improved methods for making field emission devices by which one can pre-deposit and bond the diamond particles or islands on a flexible metal foil at a desirably high temperature (e.g., near 900° C. or higher), and then subsequently attach the high-quality- emitter-coated conductor foil onto the glass substrate. In addition to maximizing the field emitter properties, these methods provide high-speed, low-cost manufacturing. Since the field emitters can be pre-deposited on the metal foil in the form of long continuous sheet wound as a roll, the cathode assembly can be made by a high-speed, automated bonding process without having to subject each of the emitter-coated glass substrates to plasma heat treatment in a vacuum chamber.

11 Claims, 7 Drawing Sheets

FIELD EMISSION DEVICES EMPLOYING IMPROVED EMITTERS ON METAL FOIL AND METHODS FOR MAKING SUCH DEVICES

FIELD OF THE INVENTION

This invention pertains to field emission devices and, in particular, to field emission devices, such as flat panel displays, using improved electron emitter particles or islands pre-deposited and adhered on metal foil, and the methods for making such devices.

BACKGROUND OF THE INVENTION

Field emission of electrons into vacuum from suitable cathode materials is currently the most promising source of electrons for a variety of vacuum devices. These devices include flat panel displays, klystrons and traveling wave tubes used in microwave power amplifiers, ion guns, electron beam lithography, high energy accelerators, free electron lasers, and electron microscopes and microprobes. A most promising application is the use of field emitters in thin, matrix-addressed flat panel displays. See, for example, the December 1991 issue of *Semiconductor International*, p. 46; C. A. Spindt et at., *IEEE Transactions on Electron Devices*, vol. 38, p. 2355 (1991); I. Brodie and C. A. Spindt, *Advances in Electronics and Electron Physics*, edited by P. W. Hawkes, vol. 83 pp. 75–87 (1992); and J. A. Costellano, *Handbook of Display Technology*, Academic Press, New York, pp. 254 (1992).

A typical field emission device comprises a cathode including a plurality of field emitter tips and an anode spaced from the cathode. A voltage applied between the anode and cathode induces the emission of electrons towards the anode.

A conventional flat panel field emission display (FED) comprises a flat vacuum cell having a matrix array of microscopic field emitters formed on a cathode of the cell (the back plate) and a phosphor coated anode on a transparent front plate. Between cathode and anode is a conductive element called a grid or gate. The cathodes and gates are typically skewed strips (usually perpendicular) whose crossovers define pixels for the display. A given pixel is activated by applying voltage between the cathode conductor strip and the gate conductor. A more positive voltage is applied to the anode in order to impart a relatively high energy (400–3,000 eV) to the emitted electrons. See for example, U.S. Pat. Nos. 4,940,916; 5,129,850; 5, 138,237 and 5,283,500, each of which is incorporated herein by reference.

Ideally, the cathode materials useful for field emission devices should have the following characteristics:

(i) The emission current is advantageously voltage controllable, preferable with drive voltages in a range obtainable from off-the-shelf integrated circuits. For typical device dimensions (1 μm gate-to-cathode spacing), a cathode that emits at fields of 25 V/μm or less is suitable for typical CMOS circuitry.

(ii) The emitting current density is advantageously in the range of 0.1–1 mA/mm$^2$ for flat panel display applications.

(iii) The emission characteristics are advantageously reproducible from one source to another, and advantageously they are stable over a very long period of time (tens of thousands of hours).

(iv) The emission fluctuation (noise) is advantageously small so as not to limit device performance.

(v) The cathode is advantageously resistant to unwanted occurrences in the vacuum environment, such as ion bombardment, chemical reaction with residual gases, temperature extremes, and arcing; and (vi) The cathode is advantageously inexpensive to manufacture, without highly critical processes, and it is adaptable to a wide variety of applications.

Previous electron emitters were typically made of metal (such as Mo) or semiconductor (such as Si) with sharp tips in nanometer sizes. Reasonable emission characteristics with stability and reproducibility necessary for practical applications have been demonstrated. However, the control voltage required for emission from these materials is relatively high (around 100 V) because of their high work functions. The high voltage operation increases the damaging instabilities due to ion bombardment and surface diffusion on the emitter tips and necessitates high power densities from an external source. The fabrication of uniform sharp tips is difficult, tedious and expensive, especially over a large area. In addition, the vulnerability of these materials to ion bombardment, chemically active species and temperature extremes is a serious concern.

Diamond is a desirable material for field emitters because of its negative or low electron affinity and robust mechanical and chemical properties. Field emission devices employing diamond field emitters are disclosed, for example, in U.S. Pat. Nos. 5,129,850 and 5,138,237 and in Okano et al., *Appl. Phys. Lett.*, vol. 64, p. 2742 (1994), all of which are incorporated herein by reference. Flat panel displays which can employ diamond emitters are disclosed in co-pending U.S. patent application Ser. No. 08/220,077 filed by Eom et al on Mar. 30, 1994, U.S. patent applications Ser. No. 08/299,674 and Ser. No. 08/299,470, both filed by Jin et al. on Aug. 31, 1994, and U.S. patent application Ser. No. 08/311,458 and 08/332,179, both filed by Jin et al. on Oct. 31, 1994, Ser. Nos. 08/361616 filed on Dec. 22, 1994, and Ser. No. 08/381375 filed on Jan. 31, 1995.

Diamond offers substantial advantages as low-voltage field emitters, especially diamond in the form of ultra fine particles or islands. These particles or islands can be made to exhibit sharp, protruding crystallographic edges and corners desirable for the concentration of an electric field. One of the most critical preparation steps for ensuring low-voltage field emission is the chemical bonding of the diamond particles or islands onto the surface of cathode conductor for good electrical contact. Experimental results teach that without strong bonding and associated good electrical contact, low-voltage field emission from diamond is not possible.

In the use of ultra fine or nanometer-type diamond particles, such as those disclosed in application Ser. Nos. 08/361616 and Ser. No. 08/381375, a good adhesion of the particles to the conductive substrate (and a desirable hydrogen termination of diamond surface) can be achieved by high-temperature heat treatment of the particles on the substrate in hydrogen plasma, typically at 300°–1000° C. While adequate emission characteristics can be obtained by the plasma heat treatment even below about 500° C., further improved properties are generally achieved by higher temperature processing. However, other device components in a field emission display should not be exposed to a higher temperature processing. For example, the glass substrate desirably has a low melting point of about 550° C. or below for the purpose of ease of vacuum sealing when the FED assembly is completed. This places an undue upper limit in the plasma heat treatment temperature and hence restricts the full utilization of the best attainable field emission characteristics from the diamond particles.

In the use of diamond islands such as are deposited by CVD (chemical vapor deposition) processing, it is also noted that better-quality diamond islands with desirably sharp crystallographic facets and corners, good chemical bonding, and good electrical contact to the conductor substrate, are generally obtained by CVD processing at temperatures higher than about 700° C. Again, because of the restrictions in the maximum exposable temperature for the glass substrate and other components, it is difficult to obtain the best field emission characteristics of CVD diamond islands by higher temperature processing.

SUMMARY OF THE INVENTION

The present invention provides improved methods for making field emission devices by which one can pre-deposit and bond the diamond particles or islands on a flexible metal foil at a desirably high temperature (e.g., near 900° C. or higher), and then subsequently attach the high-quality-emitter-coated conductor foil onto the glass substrate. In addition to maximizing the field emitter properties, these methods provide high-speed, low-cost manufacturing. Since the field emitters can be pre-deposited on the metal foil in the form of long continuous sheet wound as a roll, the cathode assembly can be made by a high-speed, automated bonding process without having to subject each of the emitter-coated glass substrates to plasma heat treatment in a vacuum chamber.

BRIEF DESCRIPTION OF THE DRAWINGS

The nature, advantages and various additional features of the invention will appear more fully upon consideration of the illustrative embodiments now to be described in detail in connection with the accompanying drawings. In the drawings.

It is to be understood that these drawings are for purposes of illustrating the concepts of the invention and are not to scale.

DETAILED DESCRIPTION

Figure 1:
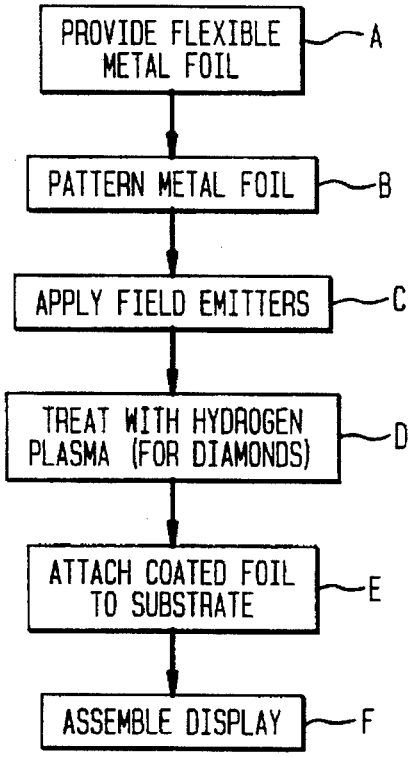
FIG. 1 is a flow diagram of a preferred process for making a field emission device in accordance with the invention.

Referring to the drawings, FIG. 1 illustrates the steps of a preferred process for preparing an enhanced field emitter structure. The first step shown in Block A of FIG. 1 is to provide a flexible metal foil onto which field emitter material is to be deposited. In the case of diamond particle emitters, it is preferred, for the sake of good adhesion of diamond on the metal foil, that carbide-forming metals such as Mo,W, Hf, Zr, Ti, V or Si be used, at least on the surface of the foil. The desirable thickness of the metal foil is typically in the range of 0.01–0.50 mm, preferably 0.02–0.10 mm. The advantage of the greater thickness of the foil as compared with conventional thin film coatings is that foil can conduct a higher electrical current with minimal heating.

Silicon is particularly desirable for good diamond adhesion in the case of plasma heat treatment of spray-coated diamond particles and for good diamond nucleation in the case of CVD deposited diamond islands. However, silicon is brittle and is not readily available in flexible sheet form. However, silicon can be utilized in the form of thin, deposited layer on the surface of other flexible metal foils such as Ni, Co, Cu or Mo. Various thin film deposition methods such as sputtering, thermal deposition, e-beam evaporation, or chemical vapor deposition may be used to deposit a silicon film. The preferred thickness of a silicon coating is in the range 0.1–2 micron. Altematively, Si can be incorporated into another flexible metal as an alloying element, to form alloys such as, Ni—Si, Fe—Si, Cu—Si, Co—Si, Mo—Si, Ti—Si or Zr—Si. The amount of Si in these alloys should be at least 2 and preferably at least 5 weight percent.

The next step shown in block B of FIG. 1 is to pattern the flexible metal foil. The foil, desirably wound on or unwound from a mandrel for high-speed processing, is advantageously patterned into a parallel stripe configuration with each stripe having the width of each cathode conductor. The patterning should maintain the structural integrity of the sheet so that it can be handled as a sheet even after metal is removed.

Figure 2:
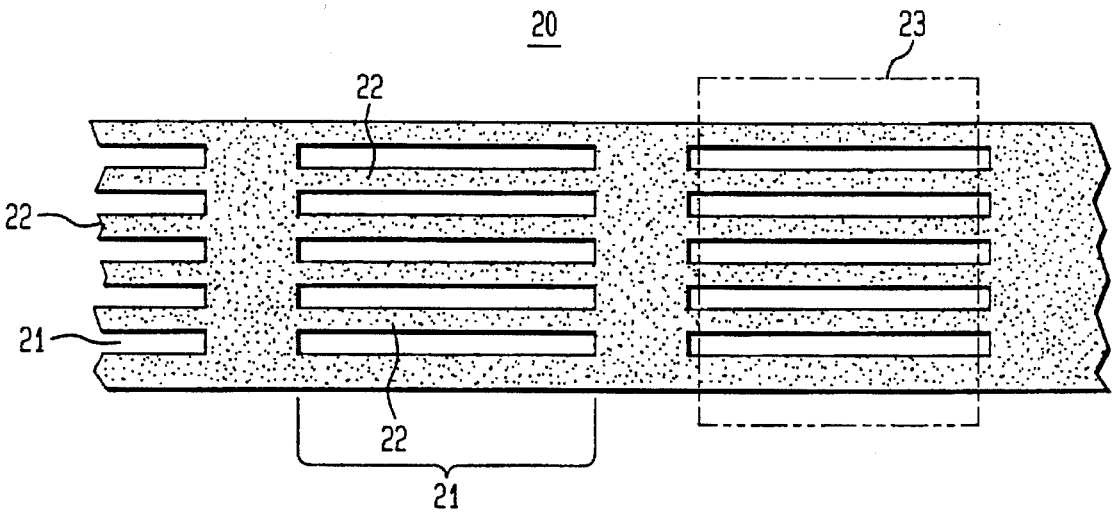
FIG. 2 is a schematic diagram describing the use of pre-patterned metal foil comprising pre-deposited electron emitter particles for a cathode conductor.

A typical pattern for use in making a plurality of display devices is shown in FIG. 2. The foil 20 is patterned by a plurality of etched away regions 21 into stripes 22. The overall size of each patterned region 21 can be slightly larger than the anticipated display substrate area 23 (shown in dashed lines). The orientation of the stripes can be either longitudinal or transverse but a longitudinal arrangement is preferred so that tension can be applied along the foil length during handling or processing to maintain the flatness of the foil.

Such a stripe pattern can be obtained by a number of known patterning techniques such as photolithographic etching, laser cut-out (or local burn-off), or for coarse patterns, mechanical cut-out (e.g. by stamping operations). Typical flat panel displays have the conductor stripe width of about 100 μm. Together with the orthogonally placed gate stripes of the same width, for example, a 100×100 μm pixel size for field emission display is defined. For the present invention, the desirable stripe width is in the range of 10–500 μm, preferably 20–100 μm.

The next step in the exemplary processing of FIG. 1 (Step C) is to adhere field emitting material to the patterned foil. The preferred field emitters are ultra fine or nanometer diamond particles such as manufactured or sold by Dubble-Dee Harris as diamond grit or by E. I. DuPont under the product name Mypolex. The diamond particle size is predominantly in the range of 0.002–1 1 μm, and preferably 0.005–0.5 μm. Such small sizes are important for lowering of the electron affinity and enabling a low-voltage field emission of electrons. The diamond particles can be applied onto the metal foil by any known technique such as by spray coating a mixture of the particles and a volatile liquid medium (such as acetone, alcohol, water), by electrophoretic deposition, or by controlled sprinkling through fine sieves. The coating typically applied in a thin layer about 0.01–10 μm thick. The layer typically is about 0.3–5.0 particles thick on average, and preferably 0.5–3 particles thick on average.

In the case of spray coating, a gentle heating to 50°–100° C. may be given to accelerate the drying of spray-coated powder through faster evaporation of the associated liquid medium. A small amount of organic binder such as used in typical ceramic powder sintering processing may be added to the liquid medium for improved adhesion of the particles. The binder material decomposes or volatilizes during the subsequent high temperature processing.

Figure 3:
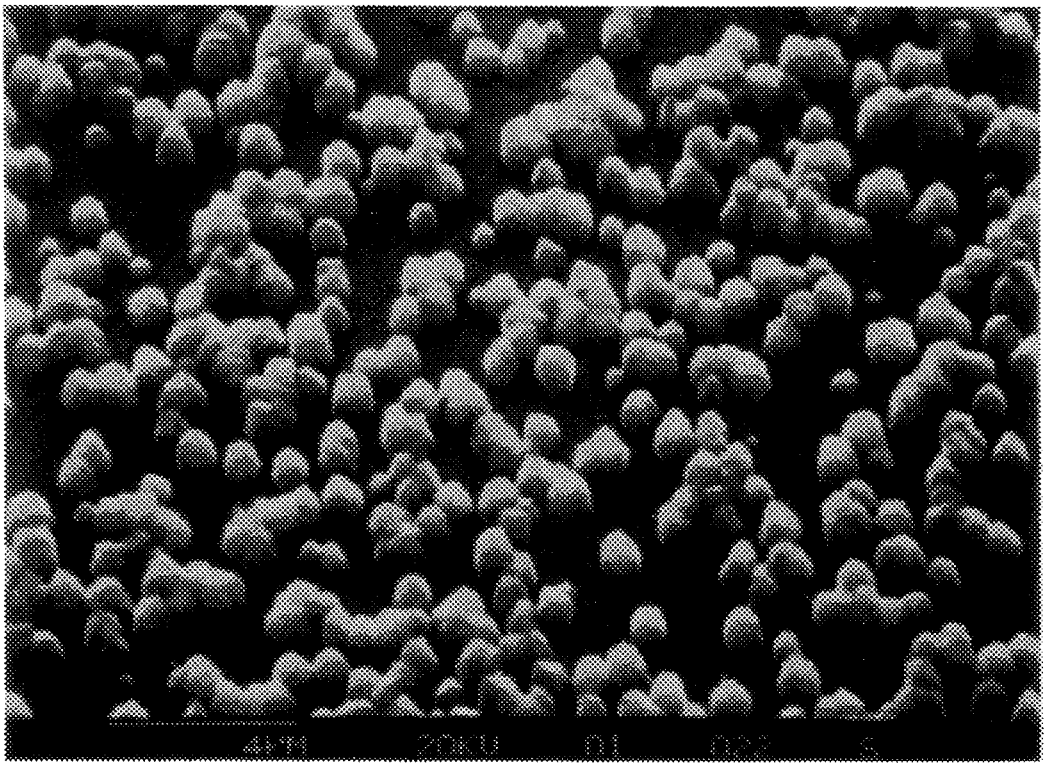
FIG. 3 is a photomicrograph showing island-shaped diamond particles prepared by chemical vapor deposition.

Alternatively, non-particulate diamond field emitters can also be used. For example, field emitters can be grown and adhered by chemical vapor deposition (CVD) of diamond islands (using 1–10 volume % methane in hydrogen at a temperature of 400°–1100° C.) on a flexible metal foil which is continuously or semi-continuously fed into the deposition chamber. An exemplary configuration of the islands is shown in FIG. 3. They were grown on a Si surface by microwave CVD deposition at ~900° C. using a mixture of 2% methane in hydrogen. Other known deposition techniques such as DC plasma, RF plasma, hot filament, or hydrocarbon gas torch method can also be used. The flat-bottomed island geometry which is achieved in-situ during the CVD deposition is particularly beneficial. The islands tend to possess sharp crystallographic facets and corners pointing toward the anode for concentration of electric field for easier electron emission, and they ensure, unlike a continuous diamond film, short paths of electron transport from the underlying or nearby metal foil to the electron emitting tips. The desired size of the CVD deposited island is typically in the diameter range of 0.05–10 μm, and preferably 0.05–2 μm. The CVD deposition conditions can be adjusted so as to introduce more defects in the diamond islands (or at least on their surface), for example, as disclosed in application Ser. No. 08/331458 filed Sep. 22, 1995.

Instead of diamond, other low-voltage electron field emitters such as AlN or AlGaN can be deposited on the metal foil, either in the form of pre-made particles or as in-situ deposited islands. These materials are preferably deposited by CVD processing using thimethyl aluminum or trimethyl gallium in ammonia gas at 500°–1100° C. For these emitter materials, the metal foil is preferably chosen from nitride-forming elements such as Mo, W, Hf, Zr, Ti, V, and Si. . Alternatively, these nitride forming metals can be deposited on another flexible metal as a thin film coating.

In the case where diamond field emitters are used, The next step (Step D of FIG. 1 ) is to provide high temperature, hydrogen plasma heat treatment in order to ensure diffusion-induced chemical bonding between the applied ultra fine diamond particles and the metal foil substrate and also to induce hydrogen termination on diamond surface. The chemical bonding is important not only for good electrical contact for ease of electron transport from the metal foil to the tip of diamond emitters but also to provide mechanical stability of bonded diamond particles during various subsequent processing such as winding into rolls, unwinding from a mandrel for continuous feeding for high-speed display assembly, and possibly pressing/rubbing operation during the bonding of the metal foil onto the glass substrate.

Typical hydrogen plasma heat treatment according to the invention is carried out at 400°–1100° C., preferably 600°–1000° C., even more preferably 800°–1000° C. The optimal duration of plasma treatment can easily be determined by experiments but typically in the range of 1–1000 minutes, preferably 1–100 minutes. The hydrogen plasma or atomic hydrogen is generated by known methods such as microwave activation or hot filament activation. The plasma may contain less than 100% hydrogen, e.g., it may be mixture of hydrogen and argon.

Figure 4:
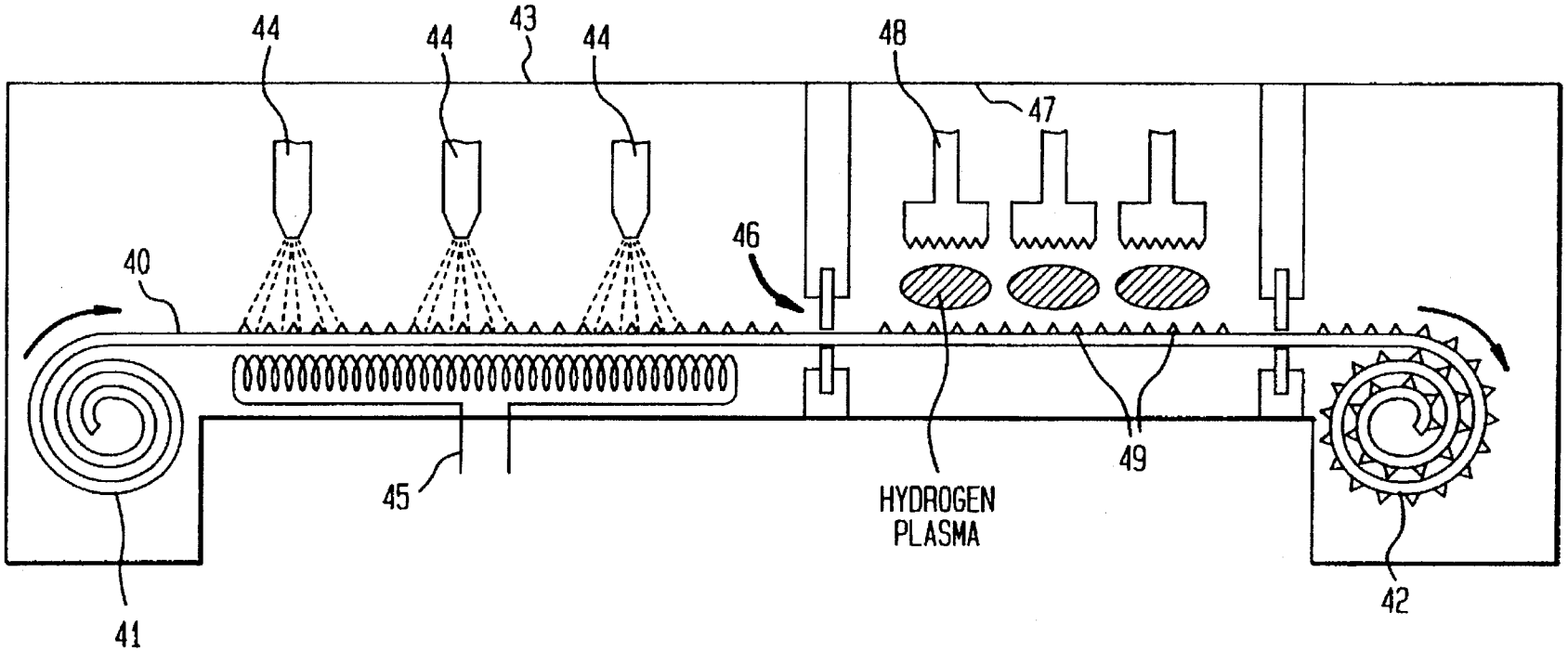
FIG.4 schematically illustrates a sequential semi-continuous process of nanodiamond deposition, drying, and hydrogen plasma heat treatment.

FIG. 4 is a schematic cross-section of apparatus useful in processing foil with diamond emitters. The foil 40 is passed from an output mandrel 41 to takeup mandrel 42, passing through a coating chamber 43 where it is exposed to one or more nozzles 44 for spray-coating diamond particles. Advantageously, chamber 43 is provided with a heater 45 to facilitate drying of the spray coated particles. After moving through chamber 43, as through a chamber partition door 46, the coated foil passes through a plasma treatment chamber 47 where the coated surface is subjected to hydrogen plasma created by one or more plasma generators 48. In operation, diamond particles 49 such as nanodiamond particles, are spray coated on the flexible metal, the liquid medium in the sprayed layer is then dried off, and the deposited diamond particles are then subjected to a hydrogen plasma heat treatment inside chamber 47. The procedure can be semi-continuous or continuous processing. However, for the ease of hydrogen plasma treatment which is typically carried out at a low gas pressure of about 0.1 atmosphere maintained in a closed chamber, semi-continuous plasma processing is more suitable for the particular sequence shown in FIG. 4. A bath type processing instead of semi-continuous or continuous processing is not excluded. When the metal foil is moving from left to right, the inter-chamber doors are allowed to open. When the foil is stationary, the doors are shut and the plasma treatment is given. During the same time, near the entrance side, the diamond particles are spray coated on newly arrived foil surface and dried immediately followed by vacuum pumping and back-filling with hydrogen partial pressure so as to be ready to be fed into the chamber. The operating cycle for each stationary step can take typically about 1–60 minutes, preferably about 2–10 minutes. For example, in a 10 minute cycle in chamber 46 6 minutes can be spent on spraying and drying while the remaining 4 minutes are used for pumping and hydrogen back filling. During the same 10 minute period, plasma heat treatment continues in chamber 47. Advantageously, chamber 47 can be a differentially pumped plasma treatment system with two to ten steps of pumping (not shown) on each side of the plasma treatment center. The finished metal foil with the diamond emitter particles attached on its surface is wound on a mandrel for subsequent assembly into display devices.

Figure 5:
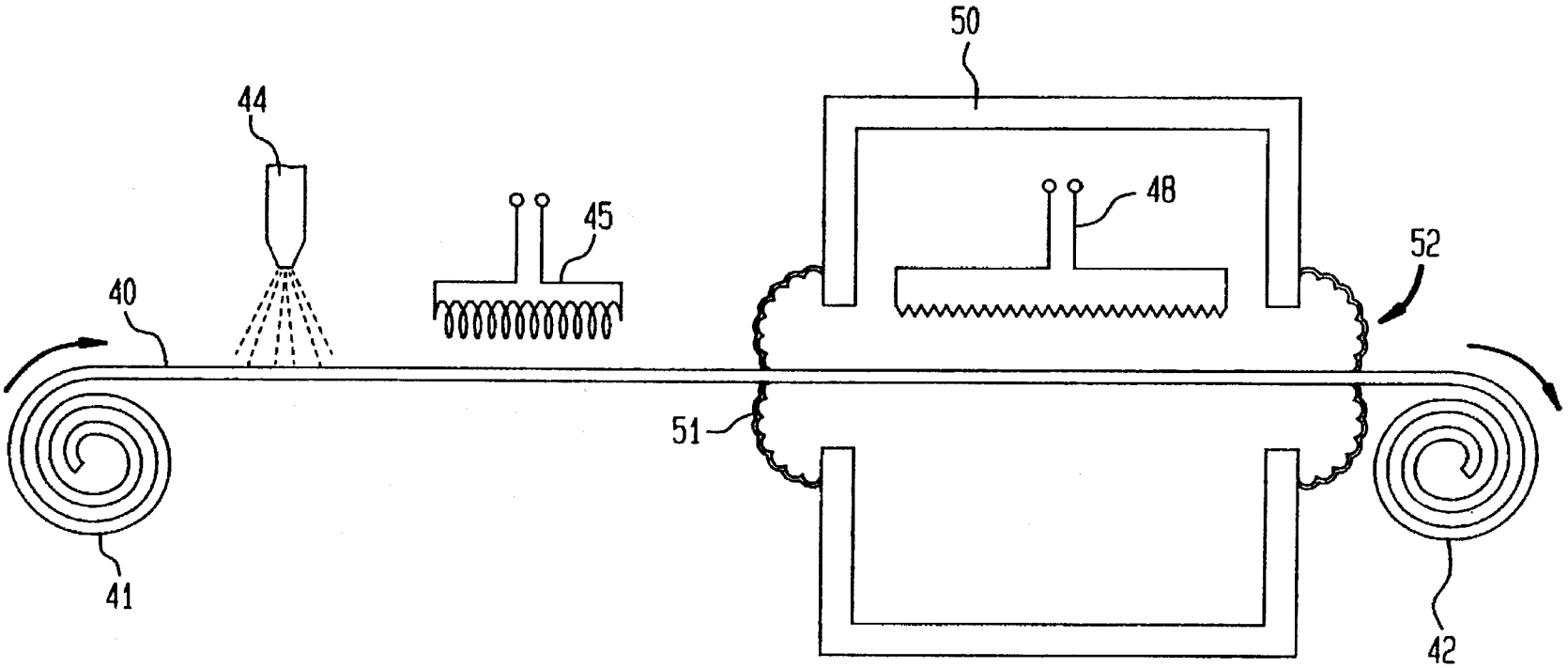
FIG. 5 is an exemplary, schematic cross-sectional diagram illustrating a continuous process of diamond emitter deposition and bonding onto the metal foil substrate.

FIG. 5 illustrates alternative processing apparatus suitable for continuous processing. The apparatus is similar to that of FIG. 4 and the corresponding components are given the same reference numerals. As the metal foil 40 is unwound from the left roll 41, diamond particles are continuously spray coated and dried. The metal foil continuously moves to the right, entering a transient chamber 50 which is bounded by two movable actordian-like shutters 51, 52 before entering the plasma treatment chamber 50. The shutter 51 to the left can grab onto the moving metal foil and travel with it to the right. After traveling a sufficient distance, the shutter releases the foil and moves back to the far left position and grabs a new site on the moving metal foil. The fight shutter (not shown) closes on the foil during the short period when the left shutter releases and moves left to grab on a new site. A similar two-shutter system operates on the exit side of the plasma chamber so that the plasma heat treated metal foils can come out and wound on a mandrel without disturbing the low pressure hydrogen atmosphere (near 0.1 atmosphere) in the chamber.

Instead of hydrogen plasma, which is typically generated by microwave radiation, RF (radio-frequency) radiation, or DC (direct current) activation, an alternative processing uses atomic hydrogen at high temperature generated for example by hot filament heating. This treatment activates the diamond particle surface into hydrogen-terminated surface and to induce chemical bonding between the diamond particles and the metal foil substrate.

CVD deposition of diamond island emitters such as depicted in FIG. 3 can be carried out by a batch processing, or preferably by semi-continuous or continuous processing.

Figure 6:
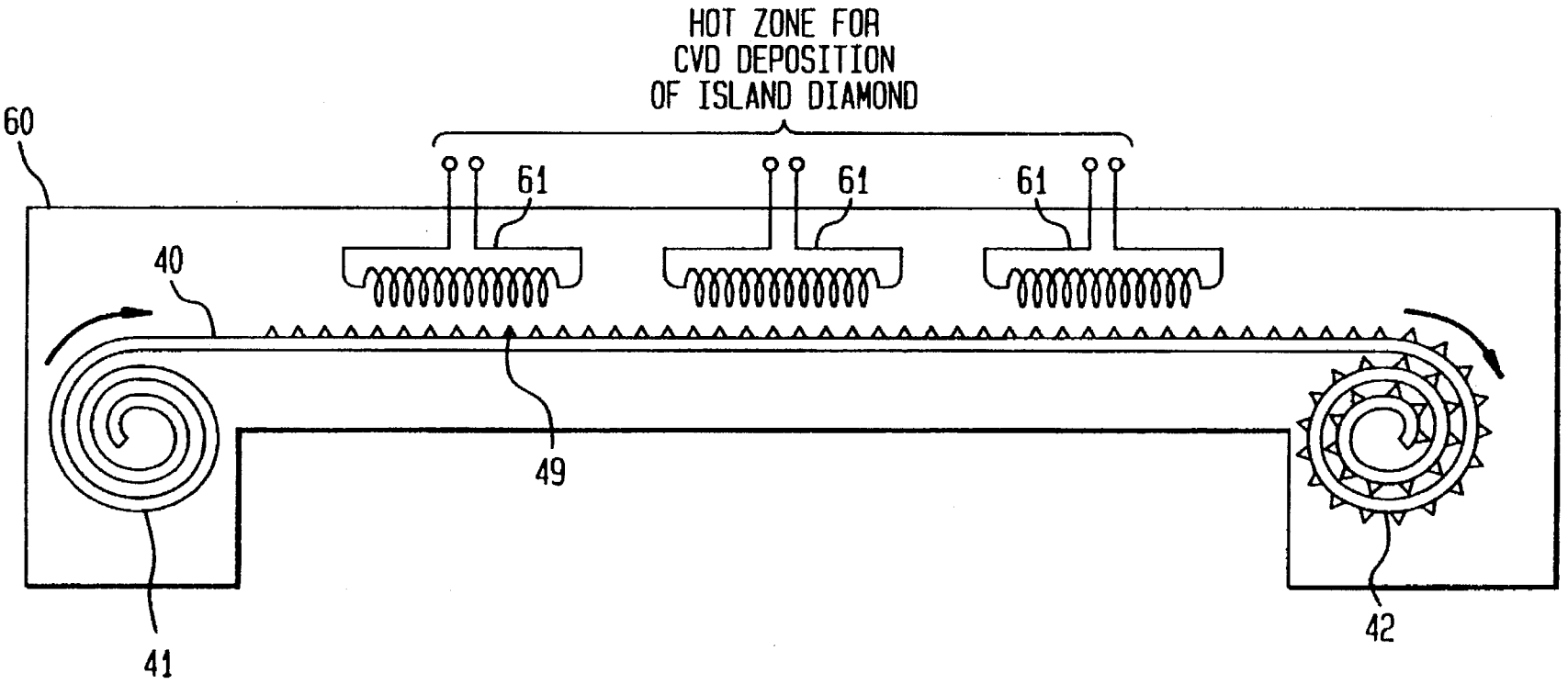
FIG. 6 is an exemplary process depicting a continuous process of diamond island deposition by hot filament or microwave plasma type chemical vapor deposition.

FIG. 6 schematically illustrates exemplary apparatus for coating metal foil 40 with diamond island emitters. Essentially, the foil is disposed in a CVD chamber 60 and passed near one or more hot filament heating elements 61 in the presence of an appropriate mixture of gases. Various other elements such as microwave plasma, RF or DC plasma, or a torch can be utilized in place of the hot filaments 61. Hot filament CVD deposition is in general cheaper in capital costs, and hence is preferred. The metal foil substrate can be mechanically abraded to promote diamond nucleation. The metal foil is continuously fed from left to right in the CVD chamber 60, going past the heating elements 61 where island diamond emitters are deposited and bonded onto the metal foil surface. Typical deposition conditions are; 0.5–6 vol. % methane (or various hydrocarbon gases) in hydrogen, 600°–1000° C. for 1–100 minute. The diamond islands are typically less than 2 μm in size.

Returning now to the overall process of FIG. 1, the next step (Step E) is to adhere the emitter-coated metal foil onto an insulating substrate such as a glass substrate to form an array of cathode conductor lines. This step is illustrated schematically in FIG. 7 where metal foil 70 is being attached to glass substrate 71. For the ease of foil attachment processing, the metal foil can additionally comprise on its backside a thin coating of adhesion-promoting material 72 which bonds the metal foil to the glass plate. The adhesion-promoting material can be a glass layer (e.g., low melting point glass with a melting point near 500° C.), solder coating (e.g., In, In—Sn, Sn, Pb—Sn, Bi—Sn), glass-sealable alloy coating (e.g., the well-known, thermal-expansion-matching Kovar alloy, Fe-28% Ni-18% Co by weight), or a polymeric adhesive such as polyimide with minimal outgassing problems. These adhesion-promoting materials can be a solid layer, powdered material (with an optional binder an&or solvent mixed with it), or a liquid material. Alternatively, the adhesion - promoting material - can be placed on the surface of the substrate.

In the case of diamond emitters, the adhesion-promoting material can be added on the backside of the metal foil either before the plasma heat treatment for the diamond particles (or the CVD processing for diamond islands) or after the treatment. Low-melting-point materials such as the solder or glass are preferably applied after the plasma treatment. Roller coating, brush coating, or line-of-sight spray coating or evaporation can be used for application of these materials. High-melting-point materials such as Kovar can be deposited before plasma treatment, using sputtering or e-beam evaporation. Alternatively, the metal foil itself can be made of Kovar, with a suitable film of a carbide-forming element (e.g., Si, Mo, etc.) added on the top surface for easy bonding of diamond emitter particles on the metal. In the case of Kovar usage, the low melting point glass can be applied (e.g., in the powder form) either on the bottom of the metal foil or on the top surface of the glass substrate itself.

The metal foil containing the adhesion-promoting layer is then placed over the glass substrate, appropriate weight (or compressive stress) is provided for good physical contact, and then the assembly is heated for melting and solidification of the metallic or glassy adhesion material (or curing of polymeric adhesion material). The use of Kovar itself as a metal-foil is particularly advantageous in view of compatible thermal expansion coefficients and associated glass-metal bond reliability.

Figure 7:
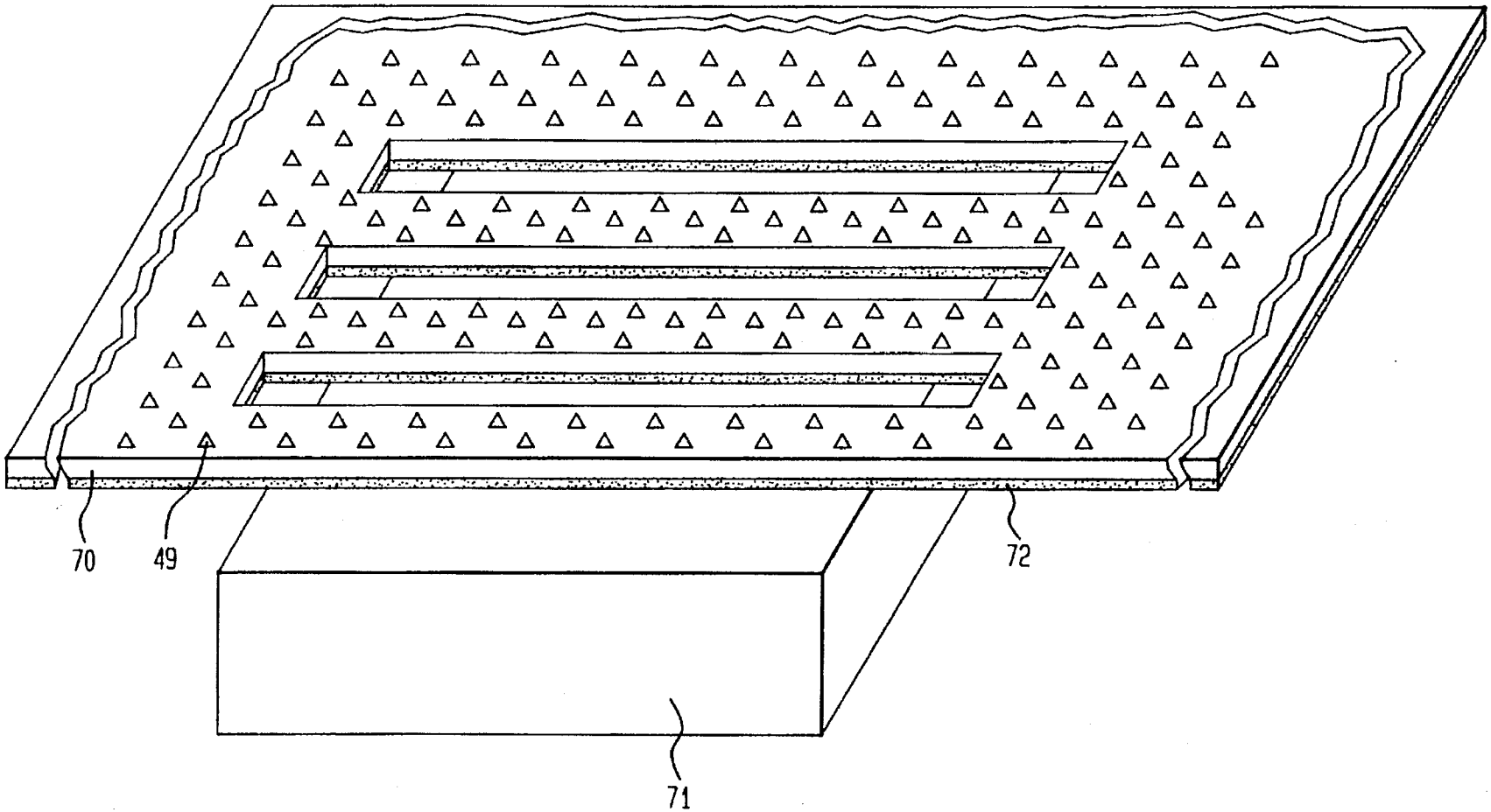
FIG. 7 is a schematic diagram illustrating the process of bonding the emitter-deposited metal foil on the glass substrate of a field emission display device.

Instead of using a pre-patterned metal foil shown in FIG. 7, a whole unpatterned metal foil can be used for diamond emitter deposition and subsequent attachment onto the glass substrate. The patterning into the desirable parallel conductor array can then be made on the already attached metal foil using photolithography or laser ablation techniques.

Figure 8:
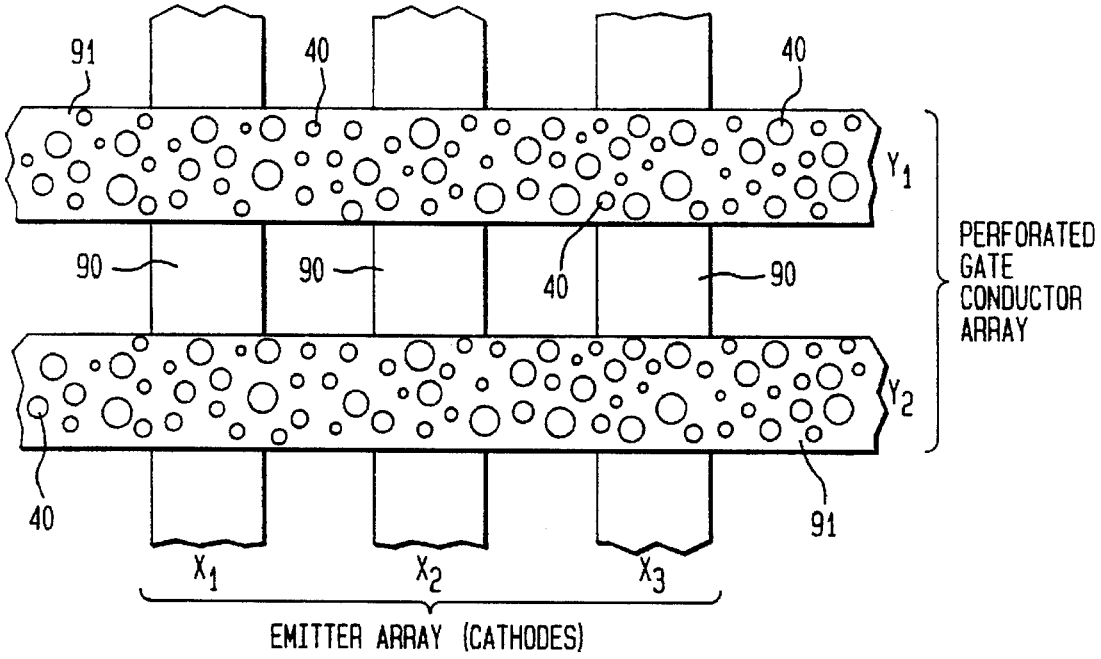
FIG. 8 is a top view showing an x-y matrix arrangement of emitter-deposited metal stripes and perforated gate conductor array in the FED device.

The next step in FIG. 1 (Step F) is to assemble the field emission display by adding a gate structure, pillar, anode, phosphor, etc., and vacuum sealing followed by the addition of various electronics and peripheral components. FIG. 8 is a schematic diagram illustrating the conductor cathode array (vertical bands 90) together with crossing gate structures 91 with perforated gate holes 40 as described in application Ser. No. 08/361616 filed Dec. 22, 1994. The cross-point defines a pixel in the field emission display.

Figure 9:
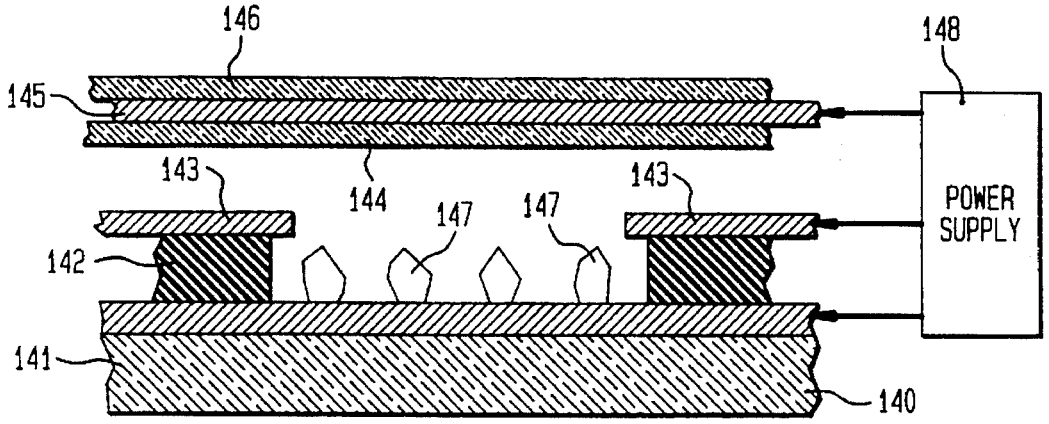
FIG. 9 is a schematic cross section of a field emission display using the emitter-deposited metal foil as cathode conductor stripes.

FIG. 9 is a schematic cross section of a preferred field emission display using emitter-coated metal foil cathodes. Preferably the metal foil cathodes have a stripe configuration as shown in FIG. 2. The display comprises a metal foil cathode 141 of carbide-forming metal adhered to an insulating substram 140 which is preferably glass. The foil 141 includes an adherent coating of low voltage diamond emitters 147 and an anode 145 disposed in spaced relation from the emitters within a vacuum seal. The foil preferably has a thickness of at least 0.02 mm. The anode conductor 145 formed on a transparent insulating substrate 146 is provided with a phosphor layer 144 and mounted on support pillars (not shown). Between the cathode and the anode and closely spaced from the emitters is a perforated conductive gate layer 143. Conveniently the gate 143 is spaced from the cathode 141 by a thin insulating layer 142.

The space between the anode and the emitter is sealed and evacuated, and voltage is applied by power supply 148. The field-emitted electrons from electron emitters 147 are accelerated by the gate electrode 143 from multiple emitters 147 on each pixel and move toward the anode conductive layer 145 (typically transparent conductor such as indium-tin-oxide) coated on the anode substrate 146. Phosphor layer 144 is disposed between the electron emitters and the anode. As the accelerated electrons hit the phosphor, a display image is generated.

Alternatively, metal foil cathode 141 can comprise nitride-forming metal and the electron emissive material can be AlN or AlGaN.

While specific embodiments of the present invention are shown and described in this application, the invention is not limited to these particular forms. The metal foil type conductor cathode array can also be used for non-display applications such as x-y matrix addressable electron sources or electron guns for electron beam lithography, microwave power amplifiers, ion guns, photocopiers and video cameras. The invention also applies to further modifications and improvements which do not depart from the spirit and scope of this invention.

The invention claimed is:

1. A method for making a field emission device comprising a plurality of substrate supported emitter cathodes comprising the steps of:

providing a sheet flexible metal foil;

pattering said sheet into a plurality of cathode regions while maintaining structural integrity of said sheet;

adhering a coating of field emitting material to said patterned sheet;

adhering said coated sheet an insulating substrate; and finishing said field emission device.

2. The method of claim 1 wherein said field emitting material comprises diamond particles and said method further comprises the step of treating the diamond coated sheet in a plasma comprising hydrogen at a temperature in the range 400°–1100° C.

3. The method of claim 2 wherein said field emitting particle are ultra fine diamond particles predominantly having particle size in the range 0.002–1 μm.

4. The method of claim 2 wherein said treating in a plasma comprising hydrogen is at a temperature in the range 600°–1000° C.

5. The method of claim 1 wherein said adhering of field emitting material comprises growing diamond material on said foil.

6. The method of claim 5 wherein said growing of diamond material comprises growing diamond islands predominantly in the diameter range of 0.05–10 μm.

7. The method of claim 1 wherein said field emitting material comprises diamond and said metal foil comprises a layer of carbide-forming material selected from the group consisting of Mo, W, Hf, Zr, Ti, V and Si.

8. The method of claim 1 wherein said field emitting material comprises AlN or AlGaN and said metal foil comprises a layer of nitride-forming material.

9. The method of claim 1 wherein said step of adhering said co to an insulating substrate comprises adhering said coated sheet to a glass substrate.

10. The method of claim 1 wherein said step of patterning said sheet comprises removing material from said sheet to form a plurality of metal stripes within said sheet.

11. A field emission device made by the process of claim 1.

* * * * *

UNITED STATES PATENT AND TRADEMARK OFFICE

CERTIFICATE OF CORRECTION

PATENT NO. : 5,648,699

DATED : July 15, 1997

INVENTOR(S) : Sungho Jin, Gregory Peter Kochanski and Wei Zhu

It is certified that errors appear in the above-identified patent and that said Letter is hereby corrected as shown below:

Column 10, line 15, "said co to" should read --said coated sheet to--.

Signed and Sealed this

Fourteenth Day of October, 1997

*Attest:*

Bruce Lehman

BRUCE LEHMAN

*Attesting Officer*

*Commissioner of Patents and Trademarks*